United States Patent [19]

Christensen et al.

[11] 4,361,079

[45] Nov. 30, 1982

[54] APPARATUS FOR EXTENDING VENTILATING CONDUITS

[75] Inventors: Hans Christensen, Gelsenkirchen; Paul Schläger, Herne; Werner Korfmann, Witten, all of Fed. Rep. of Germany

[73] Assignees: Ruhrkohle AG; Maschinenfabrik Korfmann GmbH, both of Fed. Rep. of Germany

[21] Appl. No.: 183,151

[22] Filed: Sep. 2, 1980

[30] Foreign Application Priority Data

Sep. 4, 1979 [DE] Fed. Rep. of Germany ..... 2935604

[51] Int. Cl.[3] ..... E21F 1/04

[52] U.S. Cl. ..... 98/50; 29/431; 98/115 VM; 98/DIG. 7; 138/120; 193/25 C; 285/260; 285/302; 406/196

[58] Field of Search ..... 98/40 C, 50, 115 VM, 98/DIG. 7; 138/119, 120; 299/12; 17/41, 42; 285/177, 260, 302; 29/429, 431; 406/115, 164, 196; 193/25 S, 25 C

[56] References Cited

U.S. PATENT DOCUMENTS

| | | | |
|---|---|---|---|
| 2,871,508 | 2/1959 | Hill | 17/41 |
| 3,010,144 | 11/1961 | Kochjohann | 17/41 X |
| 3,464,756 | 9/1969 | Burgess, Jr. | 98/50 X |
| 3,574,361 | 4/1971 | Contreras et al. | 285/302 X |
| 3,822,412 | 7/1974 | Carlin et al. | 285/302 X |
| 4,020,753 | 5/1977 | Efstratis | 98/40 C |
| 4,202,075 | 5/1980 | Michel et al. | 17/41 |

FOREIGN PATENT DOCUMENTS

| | | | |
|---|---|---|---|
| 2433034 | 1/1976 | Fed. Rep. of Germany | 98/50 |
| 2517574 | 4/1976 | Fed. Rep. of Germany | 98/50 |
| 2902260 | 7/1980 | Fed. Rep. of Germany | 98/50 |

*Primary Examiner*—Albert J. Makay
*Assistant Examiner*—Harold Joyce
*Attorney, Agent, or Firm*—Robert E. Burns; Emmanuel J. Lobato; Bruce L. Adams

[57] ABSTRACT

Apparatus for continuously extending ventilating conduits in tunnelling or mining environments includes a tubular store to which a funnel guide is releasably connected. A folded flexible ventilating pipe is received on the store and fastening means are provided to connect an end of the ventilating pipe to the end of the ventilating conduit to be extended. In use, the apparatus is advanced and the ventilating pipe is gradually pulled off the store and unfolded by being passed over the funnel guide.

9 Claims, 2 Drawing Figures

APPARATUS FOR EXTENDING VENTILATING CONDUITS

BACKGROUND OF THE INVENTION

The invention relates to an apparatus for continuously extending ventilating conduits in mining and tunnelling conditions.

Particularly as a result of the use of propulsion machines the rates of advance when digging tunnels and galleries have been increased to such an extent that the building of the ventilating sections to extend the run of the ventilating pipe has given rise to considerable difficulties.

In such operations it is often impossible to maintain the outlet end of the ventilating conduit directly at the tunnel face. Particular difficulties also arises when there is a connection between the ventilating conduit and the propulsion machine when the propulsion machine is moved backwards. In order to ensure the maintenance of the constant distance between the ventilating outlet opening and the face prescribed by the mining authorities, nestable ventilating pipes have been used for some time as a ventilating pipe store. Ventilating pipe stores are complicated to build, are expensive to buy and awkward to use. Furthermore they can only store relatively short lengths.

In contrast to this, it is the object of the invention to provide an apparatus for continuously extending ventilating conduits which avoids the disadvantages mentioned above and which represents a simple, safe and economical solution to the continual extending of ventilating pipes.

SUMMARY OF THE INVENTION

This object is achieved in accordance with the invention by the provision of a substantially tubular store, said store having a longitudinal axis, a funnel guide releasably connected to said store, a flexible ventilating pipe withdrawably accommodated in a folded condition on said store and fastening means adapted to fasten said ventilating pipe to said ventilating conduit, whereby, in use, said apparatus is advanced and said ventilating pipe is progressively withdrawn from said store to extend substantially parallel to said longitudinal axis of said store and passed over said funnel guide.

Advantageously, the ventilating pipe is folded into a plurality of polygons extending transversely to the length of the store, thereby shortening the length of the ventilating pipe, adjacent polygons being offset by a predetermined angle.

Preferably the funnel guide is provided on its outer surface with guiding devices, e.g. in the form of sealing rings, adapted to contact and form a seal with the ventilating pipe passing over it.

Further advantageous features of the apparatus in accordance with the invention are set out in the subordinate claims.

The technical advance of the invention resides, in particular, in that with the aid of a relatively short tubular store and a stored ventilating pipe which is appropriately constructed to be connectable to the ventilating conduit, a ventilating conduit may now be simply and continuously extended without great losses in the ventilation. The stored ventilating pipe may have a length when fully extended of about 100 meters.

BRIEF DESCRIPTION OF THE DRAWINGS

One embodiment of the invention will now be described in more detail with reference to the accompanying drawings in which.

DESCRIPTION OF THE PREFERRED EMBODIMENT

Figure 1:
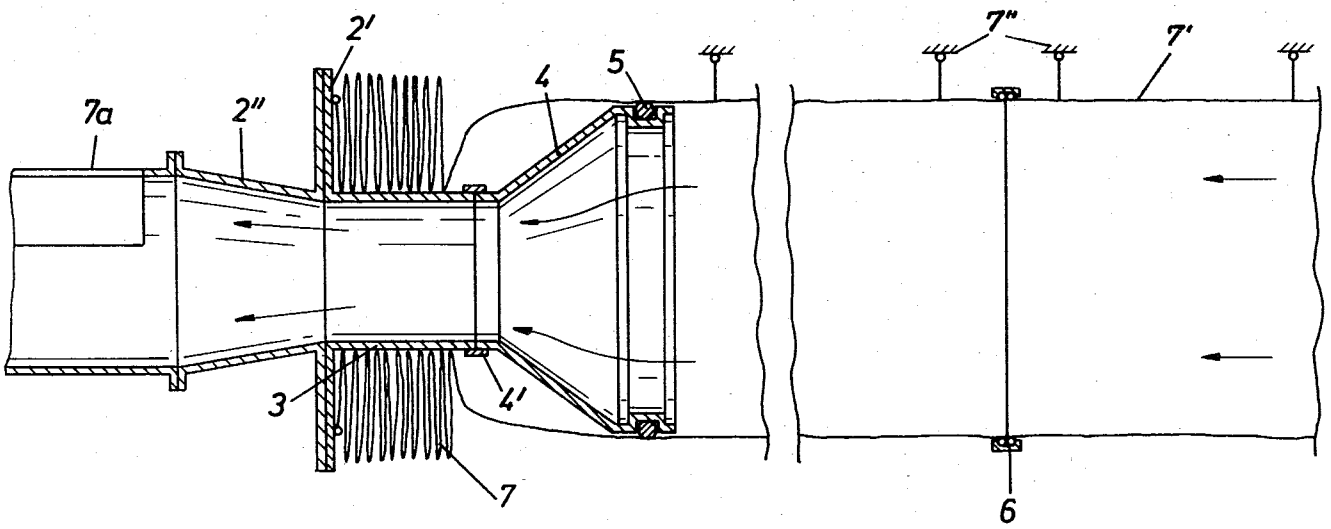
FIG. 1 is a schematic side elevation, partly in section, of an apparatus in accordance with the invention, particularly a ventilating pipe after its introduction into a line of a ventilating conduit.
Figure 2:
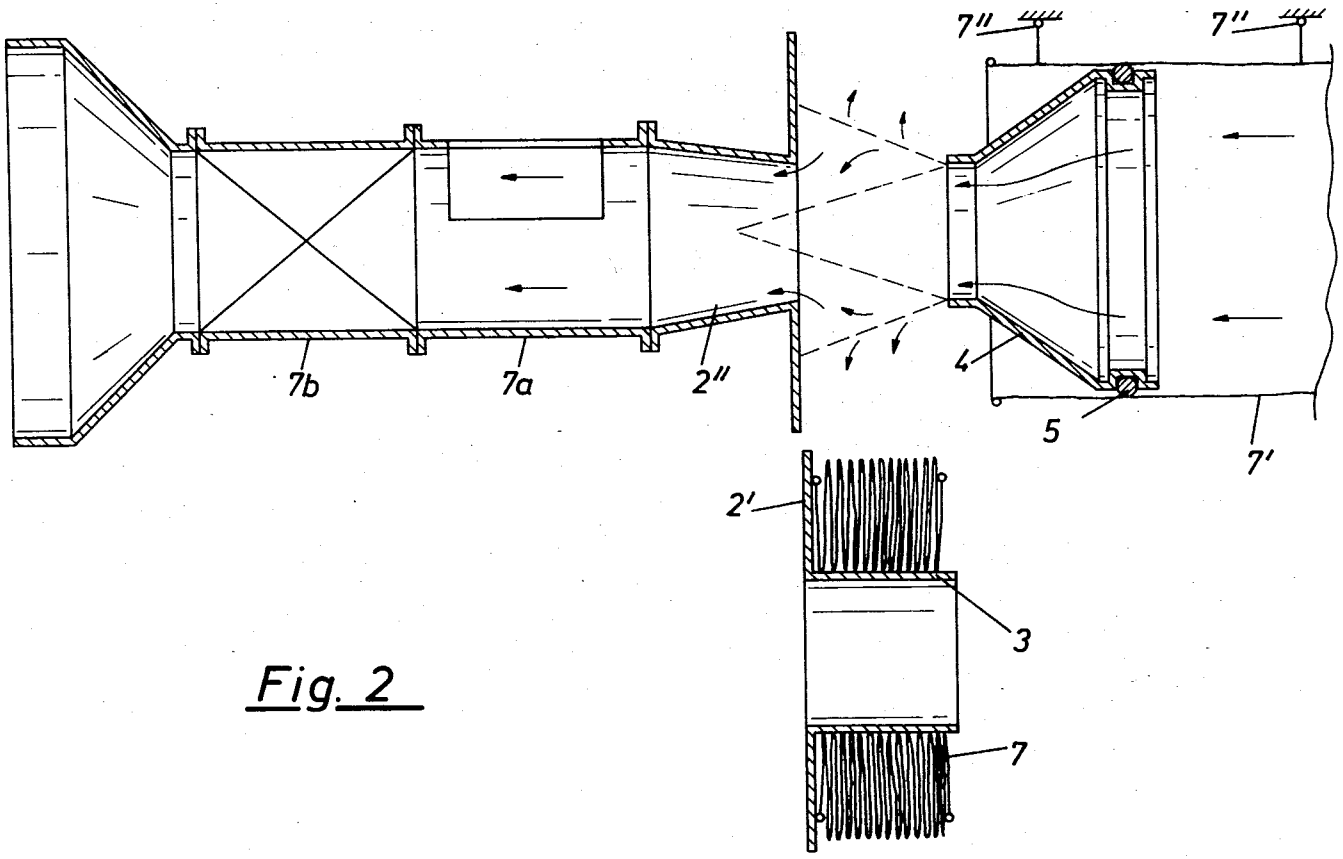
FIG. 2 is a schematic side elevation, partly in section, showing the manner of insertion of a ventilating pipe store.

The apparatus shown partly sectioned in elevation in FIGS. 1 and 2 for continuously extending ventilating conduits 7' substantially comprises a stored ventilating pipe 7 arranged on a storage tube or core 3 in conjunction with a funnel guide 4 introduced into the ventilating conduit 7'.

In the embodiment shown in FIG. 1 the stored ventilating pipe 7 which is in the form of a foldable conduit has been delivered in a transport container, placed on the storage tube 3 and inserted into the run of the ventilating conduit 7'. On the air outlet side the storage tube 3 has a connecting flange 2' extending around it which is suitable for connection, by means of a connecting pipe 2'', to an auxiliary ventilating pipe **7*a* in connection with an auxiliary blower 7*b* to apply suction to the interior of the ventilating conduit 7'**.

It has proven to be expedient to guide the entire construction suspended from tracks or to connect it to a carrier construction, for instance on a propulsion machine.

The arrows shown in the drawings indicate the flow direction of the ventilating air.

After putting the folded ventilating pipe 7 or the storage tube 3 in position, it is connected to the connecting pipe 2'' by means of the connecting flange 2'. The ventilating pipe 7, which originally has a circular cross-section, is folded up in the radial direction into polygons while shortening the axial length. The polygons in the individual fold planes are offset from one another by a predetermined angle. The cross-section of the folds can be of triangular, rectangular or multi-sided form. Ventilating pipe lengths of e.g. 100 m can be folded together in a packet and fitted in a piece not more than a meter long onto the storage tube 3.

The ventilating conduit 7' is suspended, in the embodiment shown in FIG. 1, by means of suspension elements 7'', which are only shown schematically, on the walling or on monorail suspension tracks. The same suspension elements 7'' are also to be connected to the ventilating pipe 7.

In FIG. 1 the ventilating pipe store 3 is connected to the funnel 4 by means of a connector 4', for instance a bell crank or wedge-type fastener. The length of the storage tube 3 is somewhat greater than the ventilating pipe packet in position on the storage tube 3.

The beginning of the ventilating pipe 7 is connected to the end of the ventilating conduit 7'' by means of a rapid fastener 6. When the entire apparatus constituted be the components 7, 3, 4, 2'', **7*a* and 7*b* is advanced, the ventilating pipe 7 is opened out to the cross-section of the ventilating conduit 7' by the funnel 4**.

A guide device 5 in the form of sealing rings is provided to guide and seal the funnel 4 within the ventilating conduit 7'. The funnel 4 has the function of sealing the ventilating conduit 7' from the stored ventilating pipe 7. Inflatable tubes may be provided as seals in addition to the sealing rings. Additionally, the funnel 4 has the function of accelerating the ventilating air flow from the ventilating conduit 7' up to the speed in the smaller cross-section of the ventilating pipe store 3.

What we claim as our invention and desire to secure by Letters Patent is:

1. Apparatus for continuously extending ventilating conduits in response to advancement of the apparatus relative to the ventilating conduits, said apparatus including a substantially tubular store, said store having a longitudinal axis, a funnel guide releasably connected to said store, said funnel guide having an external surface and guide means including at least one sealing ring projecting outwardly from said external surface, a flexible ventilating pipe withdrawably accommodated in a folded condition on said store, and fastening means for fastening said ventilating pipe to said ventilating conduit to enable said ventilating pipe to be progressively withdrawn from said store and to be extended substantially parallel to said longitudinal axis of said store and passed over said funnel guide in response to advancement of the apparatus in a direction away from the ventilating conduit.

2. Apparatus as claimed in claim 1 wherein said ventilating pipe is received on said store in a regularly folded disposition comprising a plurality of adjacent polygons extending substantially perpendicular to said longitudinal axis of said store, each said polygon being offset from the two adjacent polygons by a predetermined angle.

3. Apparatus as claimed in claim 1 or claim 2 wherein the length of said store in the direction of said longitudinal axis is greater than the length of said ventilating pipe in its folded condition.

4. Apparatus as claimed in claim 1 or claim 2 wherein said store has an outlet end and a connecting flange provided at said outlet end.

5. Apparatus as claimed in claim 1 or claim 2 wherein said ventilating pipe and said ventilating conduit are provided with suspension means by which they may be suspended.

6. Apparatus attachable to the free end of a ventilating conduit for extending the length of the ventilating conduit comprising: a movable tubular core; a length of foldable conduit removably stored on the outer periphery of said core in an axially folded condition and axially unfoldable to form a length of unfolded conduit; fastening means for fastening one end of the foldable conduit to the free end of the ventilating conduit; and means releasably connected to said core for movement therewith and responsive to axial movement of the core in a direction away from the ventilating conduit for progressively engaging with the interior surface of the foldable conduit to effect removal thereof from said core and unfolding thereof into a length of unfolded conduit thereby extending the overall length of the ventilating conduit, said means comprising a funnel-shaped member having its smaller end releasably connected to one end of said core and having its larger end in slideable engagement with the interior surface of the foldable conduit, and sealing means disposed at the larger end of the funnel-shaped member for sealing the outer periphery of the funnel-shaped member to the interior surface of the foldable conduit.

7. An apparatus according to claim 6; wherein the axial length of the foldable conduit when in the axially folded condition is less than the axial length of the core on which the foldable conduit is stored.

8. An apparatus according to claim 7; wherein the axially folded condition of the foldable conduit comprises a plurality of adjacent polygons extending substantially perpendicular to the longitudinal axis of the core.

9. An apparatus according to claim 6; further including means releasably connected to the other end of said core for applying a suction through the interior of the core and funnel-shaped member to the interior of the ventilating conduit.

* * * * *